United States Patent [19]

Moore

[11] Patent Number: 4,996,798

[45] Date of Patent: Mar. 5, 1991

[54] ULTRA-PRECISION LAPPING APPARATUS

[76] Inventor: Steven C. Moore, 1247 Springer Rd., Mountain View, Calif. 94040

[21] Appl. No.: 359,768

[22] Filed: May 31, 1989

[51] Int. Cl.[5] ..... B24B 5/00; B25B 5/00

[52] U.S. Cl. ..... 51/161; 51/237 M

[58] Field of Search ..... 51/237 T, 61, 283, 161, 51/206 R, 206 NF, 209 R, 119, 120, 237 M, 118; 403/20

[56] References Cited

U.S. PATENT DOCUMENTS

| | | | |
|---|---|---|---|
| 2,308,512 | 1/1943 | Hoffman | 51/161 |
| 2,309,080 | 1/1943 | Hunt | 51/237 T |
| 2,314,787 | 3/1943 | Hunt | 51/161 |
| 3,203,774 | 8/1965 | Pratt | 51/206 R |

*Primary Examiner*—Frederick R. Schmidt
*Assistant Examiner*—Mark F. Frazier
*Attorney, Agent, or Firm*—Charles M. Carman, Jr.

[57] ABSTRACT

A lapping apparatus of the "planetary" type that laps a workpiece to a true flat surface instead of to the domed surface characterizing the prior art: it includes a mechanism for spinning and orbiting the workpiece against a lapping disk that has a 360-degree mid-radial portion formed to abrade less rapidly than the radially inboard and outboard portions thereof. In one embodiment, the inboard and outboard portions of the disk are partly or entirely cut away (i.e., recessed) so as to present equal or smaller lapping surface areas than that of the mid-radial portion of the disk. In another embodiment, the abrading surfaces of the disk are formed as raised lands each of which has a shape derived as the mean length, at each orbiting radius, of the orbiting arcs that are swept by the disk across the workpiece while the workpiece is spinning through at least one full revolution. In another form, the lands are made narrower and more numerous, but have the same proportions along the various orbiting arcs. In another embodiment, the lands are made smaller in orbiting arcuate dimension everywhere but at the mid-radius. In another form, various arcuate slices of the lands are staggered with respect to one another. In another form, the disk is grooved in patterns of concentric circles or continuous spirals to provide an analogous effect. In still another form, the mid-radial portion of the disk is made with a ring of more wear-resistant material (e.g. steel) than the inboard and outboard portions (e.g. cast iron).

23 Claims, 4 Drawing Sheets

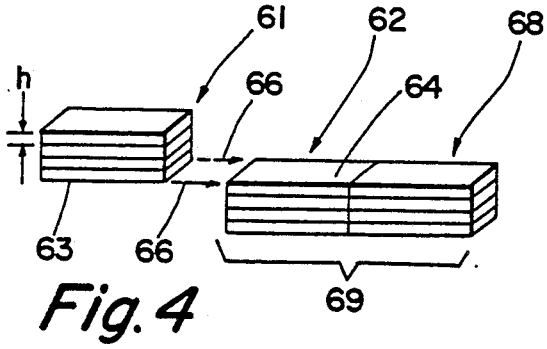
Fig. 4
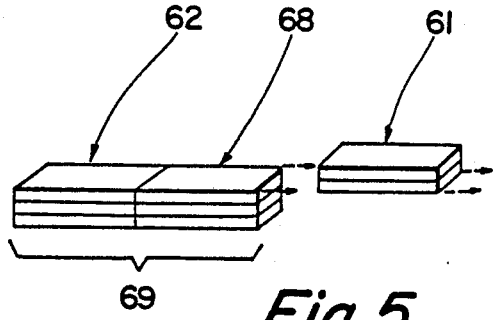
Fig. 5
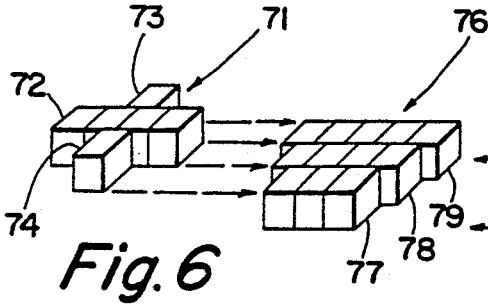
Fig. 6
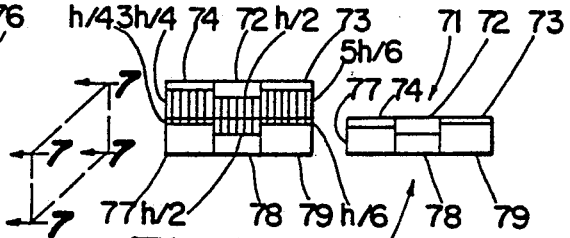
Fig. 7
Fig. 8
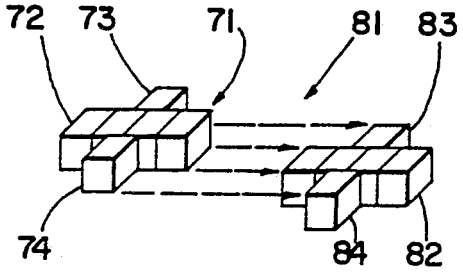
Fig. 9
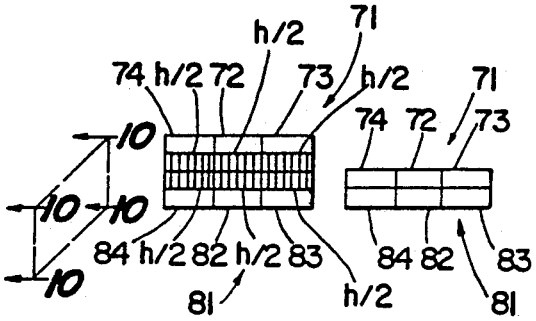
Fig. 10
Fig. 11

ULTRA-PRECISION LAPPING APPARATUS

This invention relates to lapping apparatus, and particularly to such apparatus in which a workpiece and a lapping plate have relative rotation with respect to one another about a pair of parallel axes.

To reduce the thickness of a workpiece to a precise dimension, and also to provide it with a precision flat surface—those are the usual objects of a lapping operation, particularly in the art of preparing thin quartz wafers for use in crystal oscillators and other electronic apparatus. The machine in this art derives from that invented by Grover Hunt in 1934 (U.S. Pat. Nos. 2,309,080 and 2,314,787) comprising a pair of upper and nether flat parallel disks, which are either abrasive or which serve to distribute and pressurize a fluid that carries abrasive particles. The wafer is rotated in a spinning motion about its own axis between the disks, and also in orbiting motion about the central axis of the disks, in the manner of an orbiting "planet". From this action comes the term "planetary lapping apparatus" which charaterizes such machinery as used in this art.

In their simplest effective arrangement, the abrasive or lapping disks of a planetary apparatus are held rotationally stationary, but with the lower disk fixed and the upper disk free to move up or down along the disk axis, so as to provide with its own weight the pressure needed on both sides of the wafer for the abrasive removal of material. The wafer, usually rectangular and nearly square in outline, is held in a conforming opening provided in a circular metal holder, which is much thinner than the eventual thickness of the wafer, and is provided with gear teeth around its circumference. The teeth engage the teeth of an outboard ring gear, which may be stationary, and of an inboard pinion gear, which is co-axial with the lapping disks and fits within the circular axial or inner openings of the flat-toroidal or ring-shaped lapping disks. The pinion gear is driven by a motor to both rotate and circulate the wafer in its spinning and orbiting planetary motion between the disks. It is usual to ensure that some corners of the wafer, on each rotation about the wafer axis, swing beyond the inner and outer peripheries of the lapping disks so as to avoid leaving periperal ridges on the disks as they themselves wear down in repeated use. The reason why the wafer is rotated about its own axis as well as that of the disks, is to avoid the production of arcuate ridges (centered on the disk axis) in the disks and wafer.

It is also usual to introduce fluids (e.g. water) containing a suspension of very hard abrasive particles (e.g., carborundum) between the wafer workpiece and the lapping disks; and this material abrades and wears away the material of both the workpiece and the lapping disks, so that the disks eventually wear out, and even during their lifetimes must be frequently re-dressed to restore the precision flatness of their surfaces.

In contemplating the possibility of eliminating re-dressing operations, it is important to keep in mind that the problem arises from wear of the lapping disk, which is only an unavoidable secondary effect of the desired wear of the wafer, but produces a primary problem in its own right. The need for such re-dressing comes from the fact that the wafer, although it is usually rectangular in outline—but in any case, no matter what its actual outline shape—wears away the lapping disk almost as if it (the wafer) were circular. Because the wafer is constantly rotating about its own axis, it follows that all portions of the wafer sweep across the surface of the lapping disk with an arcuate motion. If the wafer were stopped from circulating around the lapping disk, but continued its rotation about its own central axis, then the lapping disk would soon begin to exhibit a circular pattern of wear in the area directly beneath the wafer. For convenience of explanation, this pattern is herein termed a "circular trace of wear". This circular trace of wear has an undesirable effect upon the lapping disk when the wafer is orbiting as usual: greater wear takes place along the mid-radius of the lapping disk than at its inner and outer radii, for it is at the disk mid-radius that the circular trace of wear has its maximum dimension—its diameter—arranged to be generally tangent to the direction of orbiting motion. At greater or lesser radii from the disk axis, the circular trace of wear subtends much shorter arcs in the orbiting direction, and consequently causes less wear of the disk. This phenomenon has not been well understood by practitioners of the prior art, but all practitioners do agree to the empirical observation that lapping disks do wear, over time, more deeply at their mid-radii than at their inner and outer peripheries, thus tending to produce wafers that are not flat, but are domed instead, with the greatest height of the domes at the spinning axis of the wafer.

In short, the problem is this: true precision has never been a characteristic of prior art lapping apparatus—not even theoretically—particularly not theoretically.

In the prior art, the very first wafer that is lapped between newly-dressed disks is pre-ordained to come out slightly domed in cross-section, and the disks come out correspondingly concave in cross-section. With the first few wafers, the tiny departure from ideal flatness falls within the accepted tolerances of the industry. But the error is cumulative. Each wafer adds its own negative error to the disks, which cumulative error is passed to the next wafer on the next round, until the tolerances are exceeded, and then the disks must be re-dressed.

The importance of this problem may be better understood by appreciating the following background. Wafer blanks are presently produced from crystal blocks that are grown in autoclaves from seeds of pure quartz, over a period of weeks or months, and the blocks are then sawn into rectangular slices having typical thicknesses of from six to ten mils (0.15 to 0.25 mm). The wafer is then lapped to a final thickness dimension of from 2.5 to four mils (0.06 mm to 0.1 mm), with a maximum thickness variation of one ten-millionth to one twenty-millionth of a meter (0.1–0.05 micron). With such tolerances to achieve, the tendency of the apparatus to begin producing, after a period of some use, wafers that are measureably thinner near the edges than at the center, becomes a problem of grave concern.

The dressing remedy comprises substituting gear-toothed steel dressing rings for the wafer holders; but these rings are much thicker than the holders, so that production cannot continue while the dressing takes place. In effect, the re-dressing remedy represents expensive down-time during which the machine is not available for production. The thinner the wafer to be ground, and the more strict the tolerances, the more often re-dressing must take place, and the more expensive is the production process.

The present invention substantially eliminates the need for re-dressing.

Far more importantly, however, the present invention accomplishes this object by the attainment of theoretically perfect flat surfaces, in a true precision operation. In other words, not the first nor any other wafer that is lapped between the disks of the present invention comes out with a systematic variance from perfect flatness. Any variations must be accidental and random—and therefore substantially self-cancelling over the long run. With this achievement, the way is opened for an advance of the first magnitude in this and associated arts of forming, dimensioning and precision-finishing objects of all kinds.

More complex lapping apparatus than that shown in FIGS. 1 and 2 is also in common use, and includes means for driving both of the lapping disks and the outboard ring gear at differential speeds and in various directions with respect to one another and to the wafer, and for controllably varying the lapping pressure. However, the wearing of the disks to concave radial cross-sections is not well addressed by any of these elaborations, so for clarity of explanation the solution provided by the present invention will be discussed only with respect to the simplest basic structure.

OBJECTS OF THE INVENTION

Accordingly, it is an object of the present invention to provide a lapping disk, for either double or single sided lapping, that wears at a substantially uniform rate over all portions of the lapping surface thereof, when used in apparatus of the so-called planetary type in which the workpiece and the lapping disk have relative rotation with respect to one another about a pair of parallel axes.

BRIEF DESCRIPTION OF THE INVENTION

This and other objects are accomplished with a mechanism for spinning and orbiting a workpiece against a lapping disk that has a 360-degree mid-radial portion formed to abrade less rapidly than the radially inboard and outboard portions thereof. In one embodiment, the inboard and outboard portions of the disk are partly or entirely cut away (i.e., recessed) so as to present equal or smaller lapping surface areas than that of the mid-radial portion of the disk. In another embodiment, the abrading surfaces of the disk are formed as raised lands each of which has a shape derived as the mean length, at each orbiting radius, of the orbiting arcs that are swept by the disk across the workpiece while the workpiece is spinning through at least one full revolution. In another form, the lands are made narrower and more numerous, but have the same proportions along the various orbiting arcs. In another embodiment, the lands are made smaller in orbiting arcuate dimension everywhere but at the mid-radius. In another form, various arcuate slices of the lands are staggered with respect to one another. In another form, the disk is grooved in patterns of concentric circles or continuous spirals to provide an analogous effect. In still another form, the mid-radial portion of the disk is made with a ring of more wear-resistant material (e.g. steel) than the inboard and outboard portions (e.g. cast iron).

DESCRIPTION OF THE DRAWINGS

FIG. 4 is a schematic perspective view illustrating part of the theory of the invention;

FIG. 5 is a schematic perspective view further illustrating part of the theory of the invention;

FIG. 6 is a schematic perspective view illustrating inherent operational defects of the prior art;

FIG. 7 is a schematic elevation view taken substantially on the plane 7—7—7—7 of FIG. 6 and illustrating inherent operational defects of the prior art;

FIG. 8 is a schematic elevation view taken substantially on the plane 7—7—7—7 of FIG. 6 and illustrating inherent operational defects of the prior art;

FIG. 9 is a schematic perspective view illustrating the operation of the present invention;

FIG. 10 is a schematic elevation view taken substantially on the plane 10—10—10—10 of FIG. 9 and illustrating the operation of the present invention;

FIG. 11 is a schematic elevation view taken substantially on the plane 10—10—10—10 of FIG. 9 and illustrating the operation of the present invention;

DETAILED DESCRIPTION OF THE INVENTION

Figure 1:
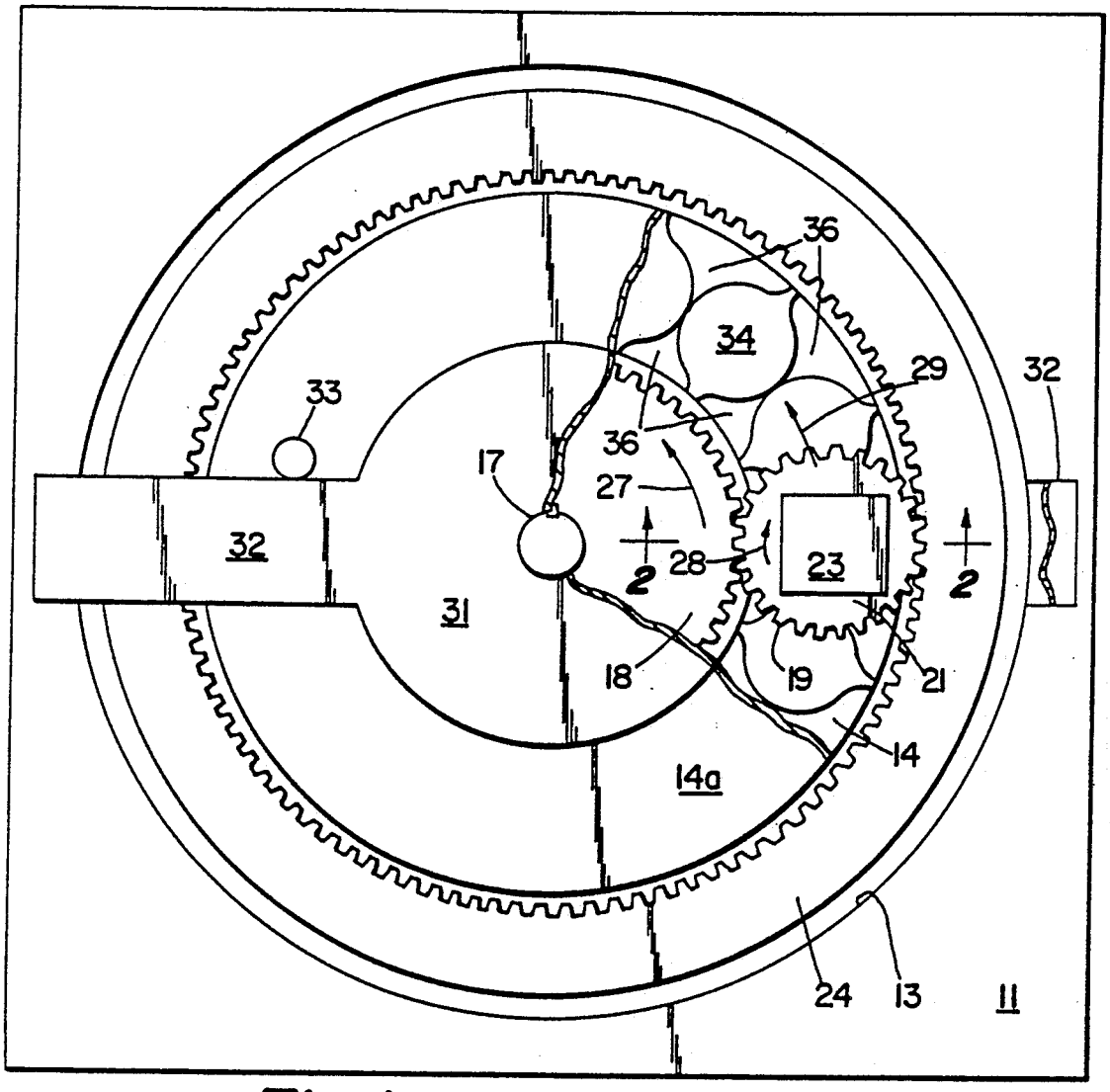
FIG. 1 is a plan view of a simple planetary lapping apparatus, with the upper lapping plate broken away partly on the plane of lines 1—1 of FIG. 2 so as to show one of the quartz wafers and one form of the structure of the invention.
Figure 2:
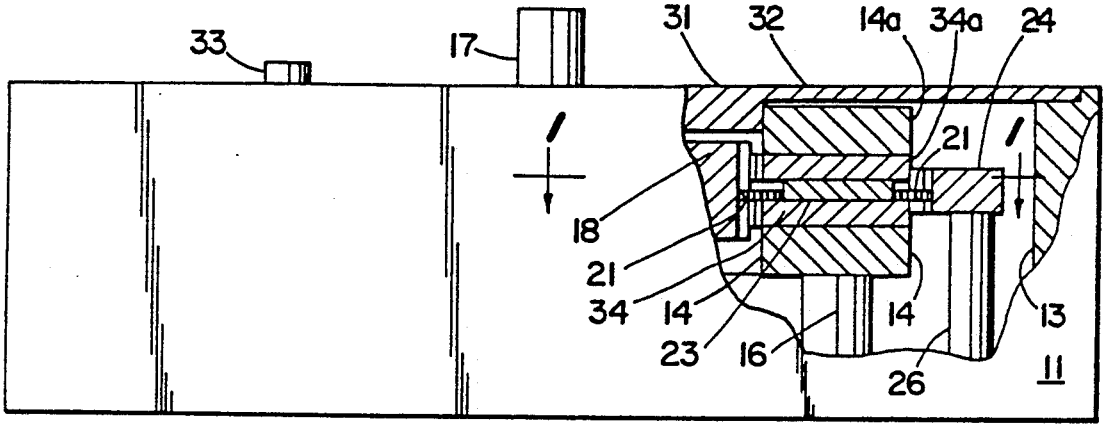
FIG. 2 is a front view of the apparatus of FIG. 1, broken away partly on the plane 2—2 of FIG. 1.

Referring now to the drawing and particularly to FIGS. 1 and 2 thereof, there is shown a simple lapping machine of the type used in the art of grinding piezoelectric quartz crystal wafers for the electronics industry. The machine includes a housing 11 containing a driving motor (not shown), and defining a recessed well 13 constituting a sump for collecting overflow or used abrasive-carrying fluid, as well as the debris resulting from lapping and grinding, which is also carried away by the fluid.

Within the well 13 are mounted a pair of stationary annular lapping disks 14, **14*a*, the nether disk 14 being supported by stanchions 16, and the upper disk 14*a* being positioned by means described below. Both disks are concentric to a central drive shaft 17, which is driven by the motor, and upon which is keyed an inboard pinion gear 18, which engages the teeth 19 of a circular workpiece holder 21. The holder 21 has a rectangular opening which conforms to and snugly fits around a rectangular flat quartz wafer or workpiece 23**.

In accordance with common practice in the art, the wafer 23 has one side dimension slightly longer than the other, so as to be rectangular but not quite square; and the rectangular opening for the wafer in the holder 21 is positioned so that the centroid of the wafer 23 is eccentric to the center of rotation of the holder, which arrangement helps to produce and maintain the desired thickness uniformity of the wafer.

To help rotate the holder 21 in differential planetary motion with respect to the disks 14, **14*a*, a ring gear 24, mounted on stanchions 26, also engages the teeth 19 of the holder. The pinion gear may be driven to rotate, e.g., in the direction of arrow 27, so as to cause the holder 21 to spin about its own central axis in the direction of arrow 28, and concurrently to orbit the holder bodily about the central axis of the apparatus (i.e., the axis of shaft 17), and in the direction shown by arrow 29**.

The upper lapping disk 14*a* rests with the force of gravity upon the workpiece 23, and is generally positioned horizontally by the shaft 17, but is free to slide axially (vertically) with respect to the shaft, and does not rotate therewith. The disk 14*a* is more precisely positioned horizontally by means of a mandrel 31, which fits into the central opening of the disk, and is in turn supported by an integral spider member 32 extending diametrically into conforming recesses in the top of housing 11. The disk 14*a* is also free to slide vertically with respect to mandrel 31 as the wafer grows thinner, but the disk is restrained against rotation by means of a stop member 33, which extends from the disk 14*a* and engages the spider member 32. The spider 32, mandrel 31 and lapping disk 14*a* can all be lifted off the axle 17 by hand, when it is desired to get at the workpiece 23.

The lapping disks 14, 14*a* are formed differently than are those generally used in the art, which are meant to directly (or indirectly through abrasive particles carried by fluid) engage the workpiece 23 with confronting cast-iron faces. Instead, the disks 14, 14*a* shown here for the present invention are provided with confronting land portions 34, 34*a* for directly engaging the workpiece 23. The lands 34 are here shown as being somewhat onion-shaped, for reasons lying at the heart of the inventive concept, which will be explained below in connection with FIGS. 3–11. Suffice it here to say that these lands 34 are particularly shaped to wear evenly at all points when exposed to the abrading action of a wafer shaped and dimensioned as shown for wafer 23.

The lands 34 are shown here as mounted on the confronting faces of the disks 14, 14*a* by any suitable means, such as adhesives or machine-screw fasteners, not here illustrated. Alternatively, the lands 34 may be formed integrally with the disks 14, 14*a*, as by merely recessing, machining or cutting away some of the interstitial material between the lands. However the shape and proximity of the adjacent lands makes it more convenient and less expensive to manufacture the lands as separate elements and to attach them to the disks during the manufacturing process.

Another reason for making the lands 34 as separate elements is that a variation of the inventive idea is to make the lands of longer-wearing material than that of the disks 14, 14*a*, such as steel, for example, and to fill the interstitial spaces 36 with interstitial filler elements, made of the usual cast-iron or a softer material, which serve to support the thin wafer surfaces between the lands, but are capable of wearing away much faster, and therefore in practice must wear at precisely the same rate—for of course they cannot wear faster without coming out of contact with one another and ceasing thereby to wear. Thus, the faster-wearing material is said to "follow", in effect, the slower wear-rate of the steel surface, and consequently does not interfere with the wear-stabilization operation of the invention. Of course, the interstitial filler elements may either be provided as portions integral with the disks, or may be separately made, as are the lands, for lower cost in manufacture.

A well-known feature of the cast-iron lapping disks of the prior art is a set of circumferentially and radially spaced distribution grooves on the confronting disk faces, which help to distribute the abrasive-carrying fluid from input orifices (not here shown) evenly across the surfaces of the disks in contact with the workpiece 23, and to wash away the used abrasive and debris particles to the sump of well 13. Another function of such distribution grooves is to help in gently breaking the adherence between plate and workpiece, induced primarily by ambient atmospheric pressure, when it is time to remove the workpiece from the machine, thus avoiding tearing or breaking the very thin and brittle quartz wafers. Such grooves may of course be provided in the disks of the present invention, but are not here shown, for greater clarity of illustration of the structure that is more closely relevant to the invention.

Another well-known feature of the apparatus of the art is a pair of non-grinding inner and outer peripheral extensions, respectively, of the lapping disks. As described in Hunt's U.S. Pat. No. 2,314,787, these extensions are recessed below the lapping surfaces of the disks for a distance less than the thickness of the holder, so as to prevent the escape of the workpiece from the holder when it is rotated to project beyond the inner and outer peripheries of the lapping surface. Such peripheral extensions may of course be provided for the disks of the present invention, but are not here shown, for greater clarity of illustration of structure that is more closely relevant to the invention.

THE ONION SHAPE

The generation of the onion shape for the lands 34 is explained with reference to FIG. 3, in which the point 41 schematically represents the axis of the drive shaft 17 and therefore the central axis of the entire apparatus; and the twenty-four arcs shown centering on axis 41 represent the sweeping paths of twenty-four points of the surface of the lapping disk 14 lying at different radii. In particular, the arc 42 represents the inner (inboard) periphery of the disk, arc 43 represents the outer (outboard) periphery, and arc 44 represents the mid-radial line of the disk (the longest of the arcs across the onion-shape). The point 46 is the center of rotation of the rectangular wafer 23; the outer circle 47 represents the sweeping path of the two most outboard corners 48, 49 of the wafer; and the inner circle 51 represents the sweeping path of the two most inboard corners 52, 53 of the wafer.

To generate the onion shape, a simple computer program was devised in which the angle subtended by the wafer along each of the twenty-four arcs was trigonometrically computed (e.g., the angle Alpha for the portion of arc 44 that is defined across the wafer when the wafer is in the position illustrated). Twenty-four such computations were made for each of thirty-six different positions of rotation of the wafer (ten degrees apart). Then the computed angles for each arc-radius were summed and averaged (the sum was divided by the number of arcs that had greater than zero length) to give the arcuate width of the onion shape at that radius. In designing such a shape for use in an actual apparatus, one might of course use many more than twenty-four arcs and thirty-six positions of rotation, but these numbers were chosen to give an optimum resolution of the shape while still preserving clarity of delineation in the graphical presentation of FIG. 3.

In effect, the apparatus defines a workpiece holder 21 having parallel spinning and orbiting axes 46 and 41, respectively (FIG. 3), a flat ring-shaped lapping disk 14 (also shown as the area between arcs 42 and 43 in FIG. 3) centered on the orbiting axis 41, and means for driving the holder 21 to rotate the workpiece 23 through a plurality of spinning and orbiting positions (one of each shown in FIG. 3) to accomplish a lapping operation. The workpiece 23 has, at each radius R of the disk 14 and at each of the spinning positions, a predetermined angular dimension (termed ALPHA) centered on the orbiting axis 41 such that the sum (termed SUMALPHAR) of said dimension (ALPHA) for each disk radius R has a corresponding first ratio (termed FIRSTRAT=SUMALPHAR/SUMALPHAMAX) with respect to the greatest (termed SUMALPHAMAX) of said sums (SUMALPHARs), the disk 14 also having an inner-peripheral portion, a mid-radial portion contiguous therewith and an outer peripheral portion contiguous with said mid-radial portion. Also, each peripheral portion of the disk 14 is formed to present at least one lapping land portion 34. Each land portion 34 has a set of angular dimensions (termed BETAs); and the sum (termed SUMBETAR) of the angular dimensions (BETAs) of the land portions 34 at each disk radius R has a corresponding second ratio (termed SECONDRAT=SUMBETAR/SUMBETAMAX) with respect to the greatest (termed SUMBETAMAX) of said last-named sums (SUMBETARs). And —most importantly—this second ratio (SECONDRAT) must always be equal to or smaller than the corresponding first ratio (FIRSTRAT) for each disk radius R—in other words: SECONDRAT<=FIRSTRAT. This is the broad condition for operation of the invention. The special case for the onion shaped lands, which—as described both previously above and also further below—wear down evenly without need for redressing, and provide the longest life for the disk 14, is that SECONDRAT equals FIRSTRAT. The special case for the diamond-shaped lands shown in FIGS. 12 and 14, which also wear down evenly without need for redressing, but provide a shorter life for the disk 14, coupled with greater ease of manufacture—ad described more particularly in reference to FIGS. 12 and 14—is that SECONDRAT is less than FIRSTRAT.

One sublety that is unavoidably implied in the above description, but is still easy to overlook, is that SUMALPHAR and SUMALPHAMAX are both derived from a single orbital position of the wafer 23, and as the wafer spins 360 degrees around its spinning axis 46. On the other hand, the parameters SUMBETAR and SUMBETAMAX are both derived from a full 360-degree orbit of the wafer around the disk 14, and SUMBETAR thus represents the total angular dimension of the land portions available on the disk 14 for contact with the wafer 23 at a given radius R. This feature makes possible the east design of land surfaces in almost any shape, as will be described in greater detail below.

Continuing the description for the special case corresponding to use of the onion-shaped lands or their equivalents, which meet the condition that SECONDRAT equals FIRSTRAT, the mid-radial zone referred to above is constituted by the sole 360-degree orbit corresponding with said greatest (SUMALPHAMAX) of said sums (SUMALPHARs) of arcuate workpiece dimensions (ALPHAs), and the first ratio (FIRSTRAT=SUMALPHAR/SUMALPHAMAX) is 1:1 at the radius of this 360-degree orbit. In other words, at the radius R corresponding to SUMALPHAMAX (arc 44 in FIG. 3), the two quantities SUMALPHAR and SUMALPHAMAX are always equal. Furthermore, each of the lands 34 is contiguous with the corresponding adjacent lands 34 at, and only at, the radius of said 360-degree orbit, as shown in FIG. 1. Also, as previously mentioned, the second ratio (SECONDRAT) of the sum (SUMBETAR) of the angular dimensions (BETAs) of the land portions at each disk radius R with respect to the sum (SUMBETAMAX) of the angular dimensions (BETSs) of the land portions at the disk radius R of said 360-degree orbit (SECONDRAT=SUMBETAR/SUMBETAMAX) being substantially equal (SECONDRAT=FIRSTRAT) to the corresponding first ratio (FIRSTRAT) for each disk radius R; whereby the land portions 34 are constrained to wear down at precisely equal rates at all points thereof and precision planar flatness of the workpiece and the lands, respectively, is established and preserved.

Figure 12:
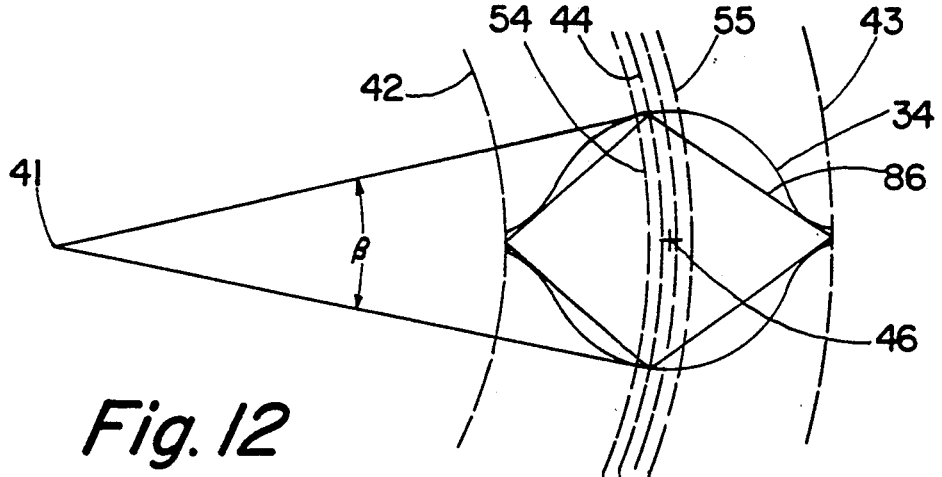
FIG. 12 is a schematic fragmentary view illustrating another embodiment of the invention.
Figure 14:
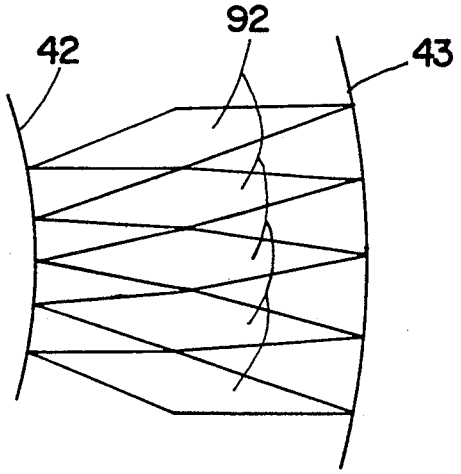
FIG. 14 is a fragmentary schematic view illustrating another embodiment of the invention.

With respect to structure such as the diamond-shaped lands of FIGS. 12 and 14, and their equivalents, the second ratio (SECONDRAT) of the sum (SUMBETAR) of the angular dimensions (BETAs) of the land portions at each disk radius R (other than the radius of said 360-degree orbit) with respect to the sum (SUMBETAMAX) of the angular dimensions (BETAs) of the land portions at the disk radius R of said 360-degree orbit being substantially less than the corresponding first ratio (FIRSTRAT) for said each disk radius R (SECONDRAT is less than FIRSTRAT); whereby the land portions 34 are constrained to wear down at precisely equal rates at all points thereof and precision planar flatness of the workpiece and the lands, respectively, is established and preserved (although the disk life is shortened).

A theoretical explanation is as follows. Consider (FIGS. 4 and 5) two blocks 61 and 62 made of the same abrasive material and brought into contact at precisely similar flat faces 63 and 64 having precisely registering outlines. If these two blocks are brought together under pressure and moved slidingly with respect to one another, as shown by the arrows 66 (the lower block 62 being fixed), they will mutually abrade each other to the same depth h. If the operation is then continued with a first of the blocks 61 in contact with a fresh third block 68, then the final result is that the second and third blocks 62 and 68 are each abraded to the same depth h, but the first block 61 is abraded to the depth 2*h*. Going one step further, one may consider the second and third blocks 62, 68 to be combined into one block 69 having double the face area, with the result that block 61 is still eroded to the depth 2*h* and the block 69 to the depth h although the same quantity or volume of material has been wasted from each. From this beginning, the principle is derived that the depths of abrasion for two blocks are inversely proportional to the areas of the abraded faces of the blocks. Assuming that the widths of the blocks are equal, taken transversely to the direction of relative sliding motion, this principle reduces to the proposition that the depths of abrasion are inversely proportional to the lengths of the blocks that sweep each other.

In other words, if block A (61 in FIGS. 4 and 5) has the length La, and block B (69 in FIGS. 4E and 4F) has the length Lb, then the depths of abrasion Ha and Hb are related as follows:

$$Ha/Hb = Lb/La \quad (1)$$

Having the blocks made of different materials merely requires multiplying one side of the equation by an ascertainable factor k.

This proportional relationship lies at the heart of the problem of unequal wear, and at the heart of the solution as well. The onion shape in FIG. 3 is the profile of the average arcuate lengths of the wafer that—for one complete 360-degree rotation of the wafer—sweep (or are swept by) the corresponding arcuate lengths of disk surface that lie between the legs of angle Beta, which at each radius is the angle of the arc across the onion shape. As shown for arc 44, angle Alpha across the wafer is smaller than angle Beta across the onion shape. But when the wafer has rotated 90 degrees, the angle Alpha will be greater than the angle Beta, which represents the average. If the wafer had the regular shape of a circle, then we would not have to use an average length of arc, for in any rotational position of the wafer the sweep arc length of the wafer would always be the same, at a given radius of the disk. For an irregular shape, however, the average length provides an equivalent result. By this principle, as an extreme example, the equivalent land for a wafer shaped in the silhouette of an elephant, a giraffe or a kangaroo would be feasible to construct, if not useful.

To better understand the theoretical imperfections of the prior art, let us now consider a simple wafer 71 shaped as in FIG. 6, which is an abstract simplification of a circular wafer or an equivalent onion shape. The wafer 71 has a central section 72 having a length of four units, and two side sections, 73, 74 of equal lengths: one unit each. Without rotating, the wafer 71 is moved as suggested by the arrows and under pressure across a block 76, having a shape abstractly representing a sector of a lapping disk, and including an inboard peripheral portion 77 of length three units, a mid-radial portion 78 of length four units, and an outer peripheral portion 79 of length five units. As in the apparatus of FIG. 1, the pressure of engagement is provided by the weight of the upper disk sector (not shown), the lower disk sector 76 being fixed. For the sake of simplicity, the motion is shown as rectilinear.

As shown in cross-section, FIG. 7, the abrasion effect is allocated in accordance with the principle of inverse proportionality. For the opposed inboard portions 74 and 77 of the wafer and disk sector, the total wear h is allocated three-fourths (3h/4) to the wafer and one-fourth (h/4) to the disk sector. For the opposed mid-radial portions 72, 78, the wear is allocated fifty percent (h/2) to the wafer and fifty percent (h/2) to the disk sector. For the opposed outboard portions 73, 79, the wear is allocated five-sixths (5h/6) to the wafer and one-sixth (h/6) to the disk sector. Note that the term h as used in FIGS. 6–11 has a different significance than when used in FIGS. 4 and 5.

Consequently, as shown in FIG. 8, at the end of the operation, the faces of the wafer and disk portions have formed one another as shown, with a domed cross-sectional profile for the wafer 71 and a concave cross-sectional profile for the disk sector.

Rotation of the wafer 71 during the abrasion period would tend to even-out the wear on the peripheral portions of both wafer and disk, but cannot change the fact that the wafer ends up domed and the disk sector transversely concave.

Now it can be explained, in comparison, how the present invention avoids domes and concavities. In FIG. 9, the wafer 71 is drawn across a land 81 having precisely the same shape (or equivalent average shape) as that of the wafer: namely a mid-radius portion of length four units, and two outboard and inboard peripheral portions 83 and 84, each of length one unit. Then, as shown in FIG. 10, all of the confronting portions must split the abrasion effect 50 percent to one portion and 50 percent to the other, by the principle of proportionality, for in each pair both portions have the same length. Consequently, both wafer and disks are constrained to erode all portions to the same depth (h/2) and a flat face is preserved across all portions, as shown in FIG. 11.

It is important to recognize that the total h depth of abrasion for each pair of confronting portions of the wafer and disks must sum up ($h = Hw + Hd$) to the same absolute value as for each of the other pairs, even if wafers and disks are not of the same material. Any other premise leads to logical absurdity, for the surfaces must remain in contact in order for abrasion to take place; and, conversely, no surface can abrade so far that it recedes to a position out-of-contact with the confronting or mating surface of its opposite element. Put in another way, the total depth h of abrasion for both portions of each pair must be equal to the total depth h for each other pair; otherwise the portions of one pair might be out of contact with each other, while the portions of another pair remain in contact; and this combination of contact and no-contact conditions is impossible. The reason why, in FIGS. 9–11, surfaces of different portions (e.g. 72, 74) of the same element (e.g. 71) abrade to the same depth, even though they have different lengths, is related to the pressure of engagement, which is not constant nor evenly distributed across the surfaces during the lapping process. If a "long" pair of surfaces (e.g., portions 72, 82), tend to abrade more rapidly than a "short" pair (e.g., portions 74, 84), the engagement pressure is automatically shifted away from the "long" pair and concentrated on the "short" pair until the latter erodes sufficiently to catch up with the "long" pair.

Now some of the implications of the inventive principle will be traced. With respect to the angular widths of the lands 34 (FIGS. 12–15) it is not necessary that they be equal to the widths of the wafer or its equivalent shape; rather it is proportionality that is required. The ratio Ld/Lw at each radius except the mid-radius must always have the same or a smaller value than at the mid-radius (arc 44), where the arc-length subtended by the onion shape is greatest. This means that the arc-length 44 can be changed at will, so long as all of the other arc-lengths subtended by the onion shape are changed proportionately.

Figure 3:
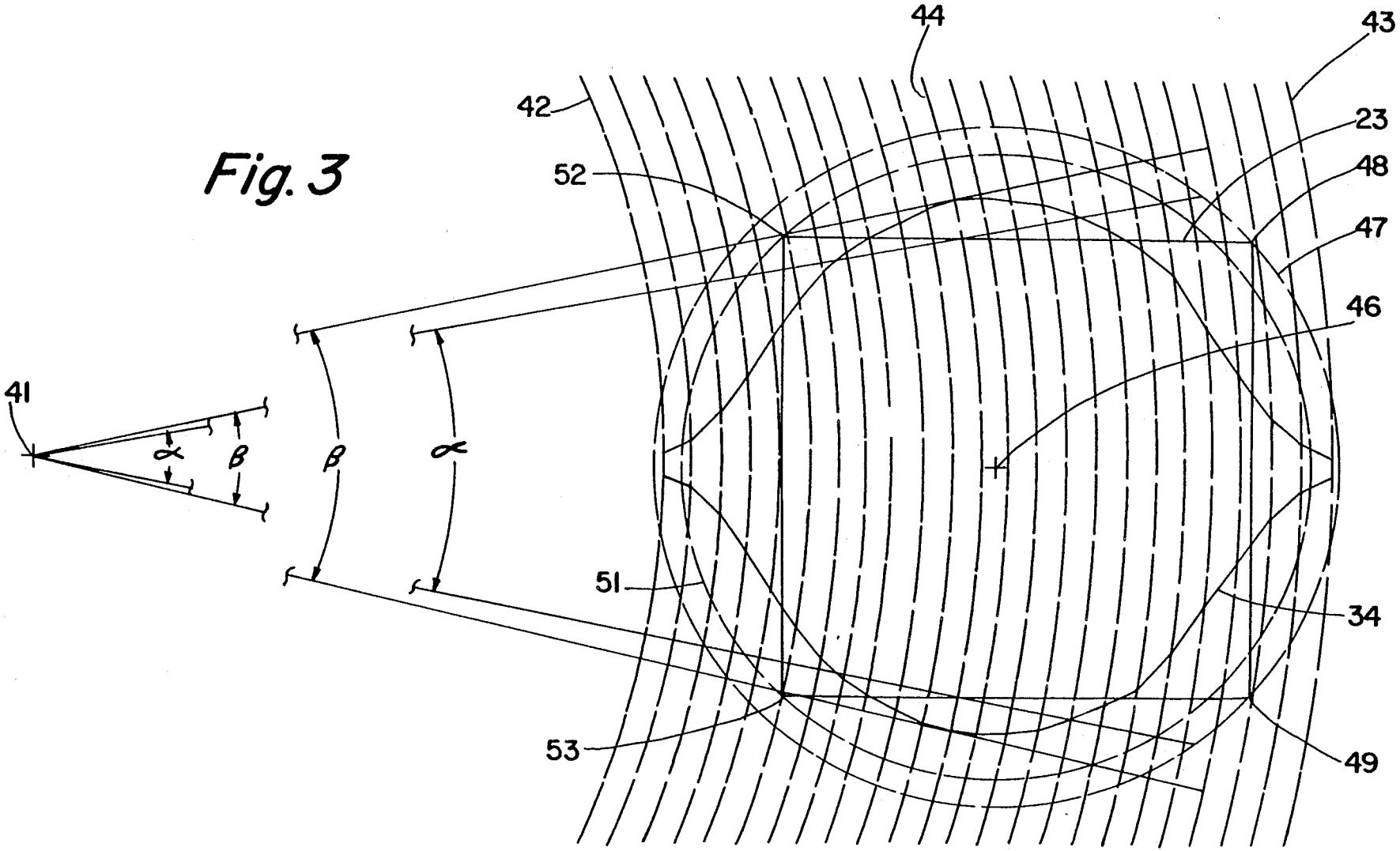
FIG. 3 is a schematic view to an enlarged scale illustrating a portion of the apparatus shown in FIG. 1.

For example, in FIG. 3 the arc-length for angle Beta, 24.11965 degrees, is not an aliquot part of a circle, 360 degrees. Therefore, to fit a set of lands 34 into the space of 360 degrees, as a practical matter, one must reduce the angular width of the onion shape by, for example, a factor of 24.00/24.11965 at every radius, as was actually done in the calculations for FIG. 1. This permits the fitting of exactly fifteen complete onion shapes precisely into the dimensions of the given lapping disk 14.

It follows also that, by the same procedure, the number of lands can be increased or decreased to any integer number; for example, one may have thirty lands each twelve degrees wide, or sixty each six degrees wide, and so on. Increasing the number sufficiently can make it possible not to use interstitial filler elements for the interstitial spaces 36 described with respect to FIG. 1, for as the number increases, the interstices grow narrower, and so does the unsupported span of wafer between the lands.

If the lapping disks are made without interstitial fillers between the raised lands 34, then it appears best to ensure that the lands of the upper disk are in confronting registration with the lands of the lower disk, in order to maintain lapping pressure on both sides of the wafer.

It should also be understood that the onion shape of the land in any assembly configuration defines the maximum, but not the minimum, proportionate width of the land, at any given radius, that is required to achieve substantially perpetual flatness without need for re-dressing. Any shape that (a) fits within the onion shape, and still (b) extends to the maximum arc length at arc 44, and (c) crosses the disk arc of the center of revolution 46 of the wafer, will wear evenly at all points and avoid the re-dressing problem. The disk arc of the center of revolution 46 must of course be crossed, or the lapping operation would leave the central portion completely unlapped, like an axle protruding integrally from a wheel. For example, the diamond shape 86 in FIG. 12, will do quite well, and might be less costly to manufacture. However, because it presents a smaller lapping area, it will result in slower lapping operations, and also will have a shorter useful life, before the lands wear too thin.

Nor, for perpetual flatness and longest life, is it necessary to preserve the precise onion shape. For example, various bands of the onion shape between the arcs (FIG. 3) could all be staggered rotationally to left and right, alternately, without changing the essential condition for uniform wear, which is that the arc-length subtended by the land at any given radius be proportional to the maximum arc-length (arc 44) as the average length of the arc across the wafer at that radius is to the greatest average arc-length across the wafer. Such an arrangement would be useful in reducing the dimensions of unsupported spans of wafer between lands.

Figure 13:
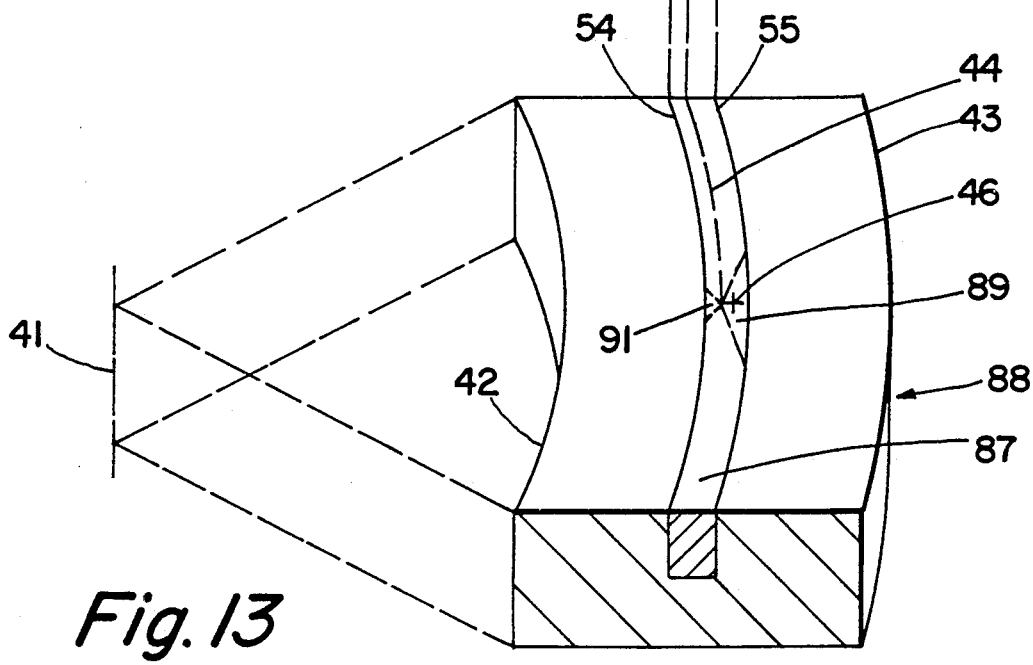
FIG. 13 is a fragmentary perspective view illustrating another embodiment of the invention.

FIGS. 12 and 13 illustrate a variational form of the invention that may also lend itself to easier manufacture. It is enough, to achieve nearly perpetual flatness, that the band of arcs beginning, say at arc 54 inboard of the maximum width arc 44, and extending to cover the center of revolution 46 of the wafer (e.g., to arc 55) be formed of a harder or more wear-resistant material than the rest of the disk surface. Accordingly, a ring 87 of steel, for example, may be fitted into a conforming groove in the cast-iron disk 88. The ring 87 extends radially from the radius of arc 54 to the radius of arc 55, but could be somewhat narrower, so long as it covers the zones of both arc 44 and center 46. In principle, the steel ring could be used alone, without association with the coplanar abrading surfaces of disk 88, but the latter surfaces are useful for supporting the fragile wafer inboard and outboard of the ring, and do assist to some degree in the lapping process. In any event, the wear of the inboard and outboard surfaces can neither go more slowly than that of the ring, for they are softer, nor more rapidly, for if they "attempt" to do so, the lapping pressure is shifted away from them. The structure of FIG. 13 falls short of the theoretical perfection of the onion-shaped land only in that (a) the ring structure may have a shorter life, and (b) to some small and very insignificant degree it avoids the principle of not having land portions crossing the interstitial zones between the land areas. As a result, at extremely rare intervals, the surface of ring 87 may need to be re-dressed. This need may be obviated, however, by forming the ring 87 with two once-around notches as at 89 and 91, of sufficient dimension to conform to the proportional relation required with respect to mid-radius arc 44; or, of course, a series of spaced notch sets of smaller dimension may be used.

FIG. 14 illustrates a further variational form of the invention, in which the diamond shape of FIG. 12 is replicated in sixty modules 92 each six degrees wide. The extremely acute angles between modules at the mid-radius may be filleted without producing sufficient departure from ideal flatness of the wafer for most uses.

Figure 15:
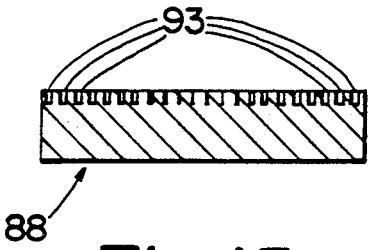
FIG. 15 is a fragmentary sectional view illustrating another embodiment of the invention.

It should be understood that any removal of lapping surface material from the inner and outer peripheral portions of the disk is a step in the right direction; and that even though such a step does not achieve the theoretical perfection of the onion shape, it will still result in requiring less-frequent re-dressing of the disk. To that end, another variational form of the invention is shown in FIG. 15, in which a number of circular or spiral grooves 93 have been cut into the lapping surface. The grooves 93 nearest the mid-radius of the disk are the narrowest, and increase in width toward the inner and outer peripheries.

What is claimed is:

1. A planetary lapping apparatus comprising:

first means for rotating a workpiece concurrently about parallel orbiting and spinning axes; and second means for abrading said workpiece on a first side thereof normal to said axes;

said second means including a portion confronting said first side of the workpiece and formed to be abraded by said workpiece and to wear away at a first orbital rate varying as a first function of radial dimension from said orbiting axis in a first ring-shaped generally mid-radial zone centered on said orbiting axis;

said confronting portion of said second means also being formed to be abraded by said workpiece and to wear away at a second orbital rate that is greater than said first rate and that varies as a second function of radial dimension from said orbiting axis in a second ring-shaped zone that is radially displaced from said first zone with respect to said orbiting axis.

2. A planetary lapping apparatus as described in claim 1, wherein:

said confronting portion of said second means is also formed to be abraded by said workpiece and to wear away at a third orbital rate that is greater than said first rate and that varies as a third function of radial dimension from said orbiting axis in a third ring-shaped zone that is radially displaced from said first zone with respect to said orbiting axis, but in the opposite radial direction from said second zone.

3. A planetary lapping apparatus as described in claim 2, and also including:

third means for abrading said workpiece on a second side thereof normal to said axes;

said third means being formed substantially as said second means, but the second and third means being arranged with the confronting abrading faces thereof facing toward one another and bracketing said workpiece therebetween so as to lap said workpiece on opposite sides thereof; and means for urging said second and third means toward one another to pressurize the workpiece abradingly therebetween.

4. A planetary lapping apparatus as described in claim 3, wherein:

said workpiece-confronting portion of said second means is particularly formed for having said wear rates as by having at least one recess formed in said second zone so as to reduce the surface area thereof that is exposed to abrasion and to correspondingly increase the wear rate of said second means in said second zone.

5. A planetary lapping apparatus as described in claim 2, wherein:

said workpiece-confronting portion of said second means is particularly formed for having said wear rates as by having at least one recess formed in said second zone so as to reduce the surface area thereof that is exposed to abrasion and to correspondingly increase the wear rate of said second means in said second zone.

6. A planetary lapping apparatus as described in claim 5, wherein:

said recesses are filled with material having substantially less resistance to abrasive wear than the material in said first zone.

7. A planetary lapping apparatus as described in claim 1, and also including:

third means for abrading said workpiece on a second side thereof normal to said axes;

said third means being formed substantially as said second means, but the second and third means being arranged with the confronting abrading faces thereof facing toward one another and bracketing said workpiece therebetween so as to lap said workpiece on opposite sides thereof; and means for urging said second and third means toward one another to pressurize the workpiece abradingly therebetween.

8. A planetary lapping apparatus as described in claim 1, wherein:

said workpiece-confronting portion of said second means is recessed to define a plurality of generally concentric grooves;

said grooves being spaced and dimensioned to provide a minimum orbital abrasive wear rate at generally the mid-radius of said second means, and greater orbital abrasive wear rates increasing toward the inner and outer peripheries of said second means.

9. A planetary lapping apparatus as described in claim 8, wherein:

said grooves are arranged in the form of a continuous spiral centered on said orbiting axis.

10. A planetary lapping apparatus comprising:

first means for rotating a workpiece concurrently about parallel orbiting and spinning axes; and second means for abrading said workpiece on a first side thereof normal to said axes;

said second means including a portion confronting said first side of the workpiece and formed of material that is abraded by said workpiece and worn down at a first orbital rate in a first ring-shaped generally mid-radial zone centered on said orbiting axis;

said confronting portion of said second means also being recessed at all points lying radially inwardly and outwardly of said first zone, so as to define second and third peripheral zones that are axially spaced from contact with said workpiece;

whereby the peripherally spinning portions of said workpiece are constrained to wear at substantially the same rate as the more centrally spinning portions thereof and substantially planar surfaces on the confronting and abrading portions of both said second means and said workpiece are induced and maintained.

11. A planetary lapping apparatus as described in claim 10, wherein:

said confronting portion of said second means also is recessed in the first zone thereof in such a way that said first zone is abraded by said workpiece and worn down at a rate that is constant at all radial dimensions from said orbiting axis.

12. A planetary lapping apparatus as described in claim 10, wherein:

said recessed portions of said second means are filled with material having substantially less resistance to abrasive wear than the un-recessed material remaining in said first zone.

13. A planetary lapping apparatus of the type including a workpiece holder having parallel spinning and orbiting axes, a flat ring-shaped lapping disk centered on said orbiting axis, and means for driving said holder to rotate said workpiece through a plurality of spinning and orbiting positions to accomplish a lapping operation, said workpiece having, at each radius of said disk and at each of the spinning positions, a predetermined angular dimension centered on the orbiting axis such that the sum of said dimensions for each disk radius has a corresponding first ratio with respect to the greatest of said sums, said disk also having an inner-peripheral portion, a mid-radial portion contiguous therewith and an outer peripheral portion contiguous with said mid-radial portion, characterized in that:

each peripheral portion of said disk is formed to present at least one lapping land portion; and the sum of the angular dimensions of the land portions at each disk radius has a corresponding second ratio with respect to the greatest of said last-named sums, said second ratio being equal to or smaller than the corresponding first ratio for each disk radius.

14. Apparatus as described in claim 13, wherein:

said mid-radial zone is constituted by the sole 360-degree orbit corresponding with said greatest of said sums of arcuate workpiece dimensions, said first ratio being 1:1 at the radius of said 360-degree orbit; and each of said lands being contiguous with the corresponding adjacent lands at, and only at, the radius of said 360-degree orbit;

said second ratio of the sum of the angular dimensions of the land portions at each disk radius with respect to the sum of the angular dimensions of the land portions at the disk radius of said 360-degree orbit being substantially equal to the corresponding first ratio for said each disk radius;

whereby said land portions are constrained to wear down at precisely equal rates at all points thereof and precision planar flatness of the workpiece and the lands, respectively, is established and preserved.

15. Apparatus as described in claim 14, wherein:

said lands are all of the same arcuate widths at said 360-degree orbit radius;

said widths being aliquot portions of 360 degrees; and the number of said lands is an integer quantity.

16. Apparatus as described in claim 13, wherein:

said mid-radial zone is constituted by the sole 360-degree orbit corresponding with said greatest of said sums of arcuate workpiece dimensions, said first ratio being 1:1 at the radius of said 360-degree orbit; and each of said lands being contiguous with the corresponding adjacent lands at, and only at, the radius of said 360-degree orbit;

said second ratio of the sum of the angular dimensions of the land portions at each disk radius (other than the radius of said 360-degree orbit) with respect to the sum of the angular dimensions of the land portions at the disk radius of said 360-degree orbit being substantially less than the corresponding first ratio for said each disk radius;

whereby said land portions are constrained to wear down at precisely equal rates at all points thereof and precision planar flatness of the workpiece and the lands, respectively, is established and preserved.

17. Apparatus as described in claim 16, wherein:

said lands are formed as diamond shapes having two free points at the inner and outer peripheries, respectively, of said lapping disk, and two contact points at the radius of said 360-degree orbit;

each of said lands being in contact with the adjacent lands at said contact points thereof.

18. A planetary lapping apparatus as described in claim 13, wherein:

said mid-radial portion of said lapping disk is formed of material having a first resistance to abrasion and wear;

said inner and outer peripheral portions of said disk being recessed at all points lying radially inwardly and outwardly of said mid-radial portion, so as to define zones substantially protected from wear;

whereby the peripherally spinning portions of said workpiece are constrained to wear at substantially the same rate as the more centrally spinning portions thereof and substantially planar surfaces on the confronting and abrading portions of both said disk and said workpiece are induced and maintained.

19. A planetary lapping apparatus as described in claim 18, wherein:

said mid-radial portion of said disk is also recessed in such a way so as to leave said mid-radial portion subject to abrasion and wear at an orbital rate that is constant at all radial dimensions from said orbiting axis.

20. A planetary lapping apparatus as described in claim 18, wherein:

said recessed portions of said disk are filled with material having a second resistance to abrasion and wear that is substantially less than that of the unrecessed material remaining in said mid-radial portion.

21. A lapping apparatus of the type including a workpiece holder, means defining a lapping surface, and means for concurrently spinning said holder and translating said holder in a predetermined direction parallel to said lapping surface while maintaining said workpiece in abrasive engagement with said lapping surface, characterized in that said lapping surface is formed to be abraded by said workpiece and to wear away at a first wear rate varying as a first function of dimension transverse to said predetermined translation direction, all of the dimensions of said lapping surface in said predetermined translation direction having the same proportional relationship to the corresponding mean dimensions of said workpiece spinning and translating in said direction.

22. A lapping apparatus of the type including a workpiece holder, means defining a lapping surface, and means for concurrently spinning said holder and translating said holder in a predetermined direction parallel to said lapping surface while maintaining said workpiece in abrasive engagement with said lapping surface, characterized in that:

said lapping surface is formed to be abraded by said workpiece and to wear away at first, second and third wear rates in corresponding first, second and third zones extending in said predetermined translation direction;

said first zone including the largest mean dimension of said spinning and translating workpiece in said predetermined translation direction, and said first wear rate varying as a first function of dimension transverse to said translation direction;

said second and third zones being displaced from said first zone in opposite directions transverse to said predetermined translation direction, and said second and third wear rates varying as corresponding second and third functions of dimension transverse to said translation direction;

at least said largest mean dimension of said spinning and translating workpiece in said predetermined translation direction having a first predetermined proportional relationship with respect to the corresponding dimension of said lapping surface; and the remaining mean dimensions of said spinning and translating workpiece in said predetermined translation direction having various second and third predetermined proportional relationships to the corresponding dimensions of said lapping surface, said second and third proportional relationships all being greater than said first proportional relationship.

23. The apparatus as described in claim 22, wherein all of said dimensions of said lapping surface are greater than zero.

* * * * *